United States Patent [19]

Robert

[11] 3,941,141

[45] Mar. 2, 1976

[54] BLOWOUT PREVENTER LOCKING APPARATUS AND METHOD

[76] Inventor: Eddie L. Robert, 9722 Galston, Spring, Tex. 77373

[22] Filed: May 3, 1974

[21] Appl. No.: 466,548

[52] U.S. Cl. ..... 137/1; 92/18; 92/24; 188/67; 251/1 A; 251/94

[51] Int. Cl.[2] ..... E21B 33/06

[58] Field of Search ..... 166/82, 84, 86; 277/73, 277/126, 127, 129; 251/1, 73, 94; 92/18, 24; 188/67; 137/1

[56] References Cited

UNITED STATES PATENTS

| | | | |
|---|---|---|---|
| 851,277 | 4/1907 | Clark | 92/24 X |
| 1,836,506 | 12/1931 | Rasmussen et al. | 277/73 |
| 3,051,433 | 8/1962 | Dale et al. | 251/94 X |
| 3,203,513 | 8/1965 | Allen | 92/28 X |
| 3,208,357 | 9/1965 | Allen et al. | 92/27 |
| 3,242,826 | 3/1966 | Smith | 92/24 |

*Primary Examiner*—Martin P. Schwadron
*Assistant Examiner*—Richard Gerard
*Attorney, Agent, or Firm*—Torres & Berryhill

[57] ABSTRACT

Locking apparatus for a ram type blowout preventer having a housing with a passageway through which a tubular member may pass; rams movable between a non-sealing position in the housing, in which the passageway is open, and a sealing position in which the passageway is sealingly closed; and an operator assembly for moving the rams between the non-sealing and sealing positions. The locking apparatus may comprise: at least one rod connected to the operator assembly reciprocable between first and second terminal positions in response to movement of the rams between their non-sealing and sealing positions, respectively; and locking means engageable with the rod when in its second terminal position to lock the rams in their sealing positions. A method of operating such a ram type blowout preventer is disclosed also.

21 Claims, 8 Drawing Figures

BLOWOUT PREVENTER LOCKING APPARATUS AND METHOD

BACKGROUND OF THE INVENTION

1. Field of the Invention

The present invention pertains to flow control devices. More specifically it pertains to flow control devices suitable for controlling a well during drilling operations. More specifically it pertains to such flow control devices which are known in the industry as "blowout preventers".

2. Description of the Prior Art

Since the early days of the petroleum industry, "blowout" of a well during drilling operations has been a major concern. If the proper precautions are not taken, the drill bit may enter a high pressure formation causing oil and/or gas to rush out of the well creating hazards to both life and property.

Although use of the first mechanical well control equipment was apparently not recorded, the development of numerous inventions to prevent blowouts has occurred since the late nineteenth century up to the present date. Continuing developments bear witness to the unending search for new and improved method of preventing loss of control of well pressures at the surface.

The flow control devices, known in the industry as blowout preventers, for controlling well pressures may be classified under one of three broad forms: the inverted packer type, the ram type and the stuffing box or pressure operated drilling packer type. The purpose of any of these types of blowout preventers is to seal the annular space between the drill stem and the casing quickly, easily and safely.

One of the most popular and widely used of these three types of blowout preventers is the ram type. Such preventers generally comprise a housing which may be attached to the well casing and which is provided with a passageway through which the drill string may be passed. Carried in the housing is a pair of rams which are disposed for reciprocal movement between retracted positions, in which the annular area between the drill string and the blowout preventer passageway is open, and an extended position, in which the rams engage the exterior of the drill string and sealingly close the annular space between the drill string stem and casing. The rams are usually connected by a rod to a piston and cylinder assembly carried by the blowout preventer housing. To close the blowout preventer (to move the rams to the extended or sealing position), pressure is applied to the piston and cylinder assembly forcing the rams into sealing engagement with the drill string. To open the blowout preventers, pressure is simply applied to the opposite end of the piston and cylinder assembly. The most popular ram blowout preventers are made by Cameron Iron Works, Inc. and Schaffer Tool Works, a subsidiary of the Rucker Company. Blowout preventers made by these companies may be seen in the 1972–73 revision of the Composite Catalog of Oilfield Equipment and Services published by the Gulf Publishing Company.

When a blowout preventer is closed in a well that is "blowing out" or threatening to "blowout" or when the well is to be left unattended, it is desirable to lock the rams in this closed position. Otherwise, extreme pressures must be maintained on the piston and cylinder assemblies of the blowout preventer. In the past, a manually operated locking screw has been used which, when screwed in place, engages a "tail rod" attached to the piston of the blowout preventer piston and cylinder assembly, preventing return of the piston to the retracted or open position. Such locking apparatus utilized in one of Cameron's blowout preventers may be seen at page 960 and 961 of the aforementioned Composite Catalog.

Although a relatively long period of time may be required to engage such locking apparatus, it has been found to be suitable for most land based drilling operations. However, such locking apparatus may not be suitable for subsea drilling. Much subsea drilling is conducted with the blowout preventers placed near the floor of the body of water in which the drilling is being conducted. Operating a manually operated locking mechanism at the bottom of an ocean is impractical if not impossible. Therefore, other locking apparatus has been developed.

One such remotely operable locking apparatus, developed by Cameron, is shown on page 962 of the Composite Catalog. In such a blowout preventer, the tail rod, which is attached to the operating piston, is tapered on the end for engagement by a hydraulically actuated wedge member which is mounted for reciprocal movement along a path generally perpendicular to the axis of the tail rod. When it is desired to lock the blowout preventer in the closed position, the rams are closed and pressure held thereon until pressure is applied to the wedge member. The wedge member is wedged behind the end of the tapered tail piece. One advantage of such locking apparatus is its adjustability, allowing the ram to be locked wherever it stops regardless of wear to the ram seal, etc. Another advantage is that the lock is not actuated every time the ram closes but only when it is desired to lock the rams. However, there are some disadvantages of such locking mechanisms. Occasionally the tapered surfaces are wedged so tightly together that they cannot be released by hydraulic pressure. Furthermore, if the planes on the tapered wedge or the tapered end of the tail rod have any lubricant on them, it is possible to apply enough force to the rams to release the locking device. In addition, such a blowout preventer requires at least four hydraulic hoses. The more hydraulic hoses required in a subsea installation, the greater the connection and maintenance problems.

Another type of locking apparatus, which is used by Schaffer Tool Works and which may be seen on page 3873 of the aforementioned Composite Catalog, is the type in which the preventer piston assembly is provided with radial latches which, upon closing, automatically engage annular surfaces within the cylinder to positively lock the rams in the closed position. One advantage of such lockout apparatus is that only two hydraulic hoses are required for the blowout preventer. However, there are also some disadvantages of this type of lock. For one, the lock is actuated each time the blowout preventer is closed because the lock is operated by closing pressure. This is a disadvantage in that it is not always desired to lock the rams each time they are closed but only on occasions when the well is actually blowing out, threatening to blow out or is to be left unattended (such as when the rams are closed to hang the drill string and the drilling vessel is moved due to bad weather or any other reason). Furthermore, actuating the locks each time the rams are closed may cause excessive wear and a greater chance of malfunction when the lock is actually needed. In addition, this type of lock locks the ram in exactly the same position every time. This is a disadvantage because the rams may need to be locked in a further closed position as the ram seals wear. Otherwise, the ram may be locked before it has traveled inwardly enough to completely seal off against the drill string. Furthermore, most blowout preventer rams are made to run over the center and when one ram has moved past the locking position the other ram may not have moved enough to be locked.

A still further disadvantages of either of the above mentioned locking systems is that there is no good way to check whether or not the lock has been effected. The radial latch type lock cannot be checked since applying ram opening pressure would unlatch the lock. Opening pressure can be applied to the wedge type lock to determine whether or not it has been effected, but a low opening pressure will not assure that it is locked since the ram might be slightly hung or stuck and not actually locked. Therefore a high pressure must be applied to be sure the lock is effected and this tends to overload the locking device.

Great strides have been made in the development and improvement of blowout preventers. Improvements have also been made in locking such blowout preventers in the closed position. However, it is apparent that the present state of the art in locking blowout preventers still leaves much to be desired in efficiency, reliability and other operating, manufacturing and maintenance characteristics.

SUMMARY OF THE PRESENT INVENTION

The present invention pertains to improved locking apparatus, and operation thereof, primarily for use with ram type blowout preventers. The locking apparatus may comprise a rod member attached to the operating piston of the blowout preventer, and slips radially movable from retracted positions, not engaging the rod, to contracted positions engaging the rod. Movement of the slips between retracted and contracted positions is effected by cooperating wedge surfaces. The wedge surfaces are carried on a piston assembly surrounding the rod member and disposed within a cylinder for reciprocal movement between first and second terminal positions, in which the wedge surfaces are moved between positions corresponding with retracted and contracted positions of the slips, respectively. The piston assembly is provided with retainer means and differential pressure areas so that when pressure is applied to close the blowout preventer rams, the same pressure is applied to the locking piston assembly to release it for movement to the second terminal position (corresponding with contracted slip positions and engagement with the rod assembly). Movement of the locking piston assembly and slips is then actually effected by a relatively low pressure applied to another portion of the piston assembly. The retainer device can then be reactivated, locking the piston assembly, wedge surfaces, slips and consequently the rams of the blowout preventer in the closed or sealing position.

The locking apparatus of the present invention combines advantages of the aforementioned prior art locking apparatus without the inherent disadvantages thereof. For example, the locking apparatus of the present invention operates on the same two hydraulic lines used to open and close the blowout preventer rams. However, unlike the radial latch lock of the prior art, it may be actuated only when desired to lock the rams. The locking apparatus of the present invention is designed to grip the tail rod and lock the ram in any position where it stops. This compensates for wear of the ram seals and allows locking of the rams in a completely sealed position even if one of the rams moves past center. The locking apparatus of the present invention may be operated by application of a relatively low pressure on the ram opening line while a relatively high pressure is held on the closing line. Even this relatively low pressure required to actuate the locking device may be isolated from the opening chamber of the ram itself by optional use of a pilot operated check valve. The locking apparatus may be unlocked by simply applying ram closing pressure. This is a definite advantage in that all of the load is removed from the lock itself before it is released.

In summary, the locking apparatus of the present invention is more efficient and reliable than those of the prior art. It is positive in action and easily checked for assurance of locking. Many other objects and advantages of the invention will be apparent from a reading of the specification which follows in conjunction with the accompanying drawings.

DESCRIPTION OF A PREFERRED EMBODIMENT

Figure 1:
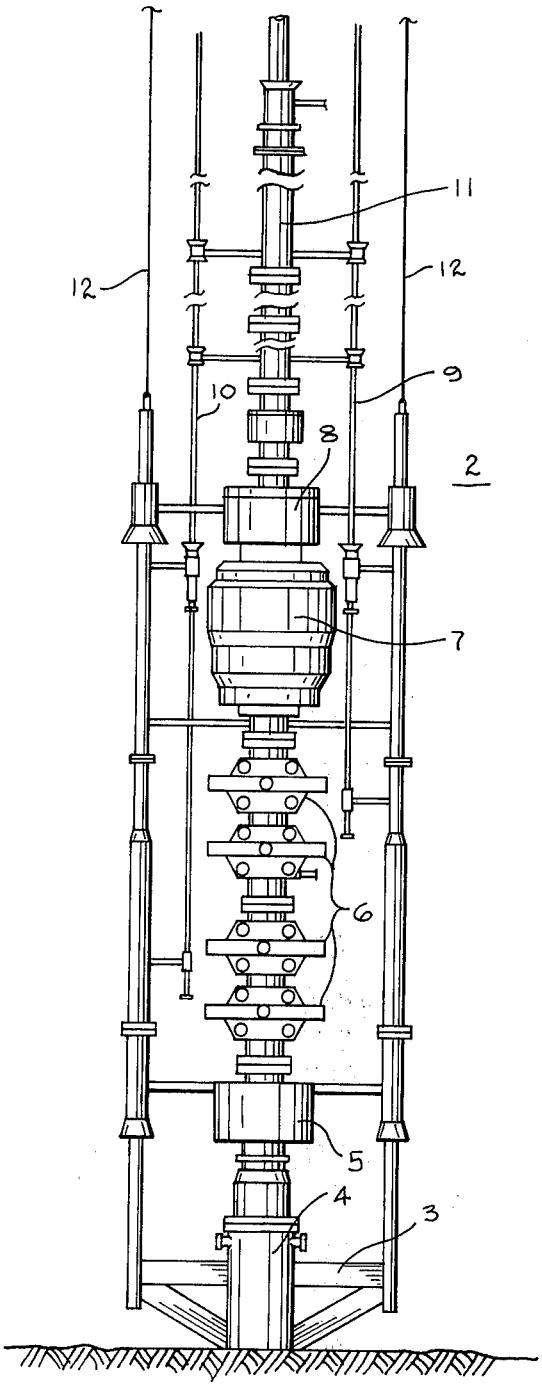
FIG. 1 is an elevation view of a subsea bottom supported wellhead illustrating various flow control devices (blowout preventers) which may be used in subsea drilling.

Referring first to FIG. 1, there is shown a typical installation for drilling a well at a subsea location. Supported on the floor 1 of a body of water 2 is a landing base 3 and wellhead 4. The various casing strings (not shown) are connected to the wellhead 4 and penetrate the substrate 1. Connected to the wellhead 4 by an underwater connector 5 is flow control apparatus or blowout preventer stack which may include ram type blowout preventer 6 and a pressure operated drilling packer 7. Other connector devices 8, hydraulic lines 9 and 10 and other auxiliary equipment may be provided. A conductor casing 11 may extend from the blowout preventer to the surface of the body of water from which drilling takes place from a drill ship (not shown) or other type of drilling platform. Guide cables 12 may be provided for guiding various components toward or away from the wellhead 4.

The drill string (not shown) is lowered through conductor 11, blowout preventers 7 and 6, connector 5 and wellhead 4 into the well hole where drilling, of course, takes place. The purpose of blowout preventers 6 and 7 is to control the flow of fluids in the annular space between the drill string and the surrounding components of the drilling apparatus. In particular, the blowout preventers 6 and 7 are provided to control and prevent blowout of the well in case a high pressure formation is encountered.

Figure 2:
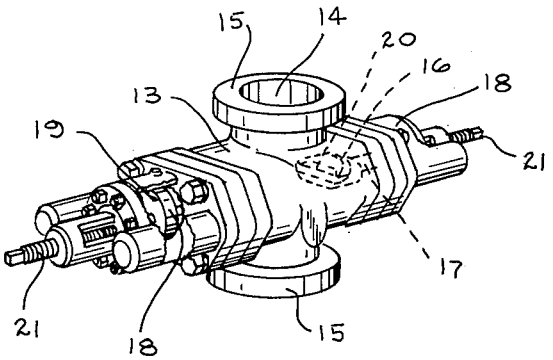
fig.2 (PRIOR ART)
FIG. 2 is a perspective view, a portion of which is shown broken away, illustrating a ram type blowout preventer of the prior art, having a screw type locking device.

FIG. 2 illustrates a typical ram type blowout preventer, similar to the blowout preventers 6, shown in FIG. 1. However, the blowout preventer shown in FIG. 2 is primarily for land based drilling operations and is provided with a locking apparatus not suitable for use in subsea drilling. This figure is included merely for a general understanding of ram type blowout preventers. Such blowout preventers generally comprise a housing 13 through which is provided an opening or passageway 14 which is placed in communication with the well hole. Flanges 15 on the housing may be provided for connecting the preventer to other components of the drilling apparatus. Carried in the housing 13 for reciprocal movement between inward and outward positions are a pair of ram members 16. These rams may be attached by rods 17 to piston members 18 which are disposed for reciprocation within cylinders on opposite ends of the housing 13. The piston and cylinder assemblies 18 and 19 may be referred to as the blowout preventer operators. The rams 16 are provided with seals 20 which when in the inward or closed position engage the drill string which is generally centrally disposed within the passageway 14. When in the closed position, these rams 16 seal around the drill string and effectively close the annular area bounded by the outside diameter of the drill string and the passageway 14.

As previously mentioned, many blowout preventers are provided with some sort of locking apparatus so as to lock the ram 16 in the closed position when desired. The particular blowout preventers shown in FIG. 2 are provided with locking screws 21 which may be manually turned to engage a portion of the piston assembly 18 so as to hold the rams 20 in the closed position, if so desired. As previously mentioned, such manually operated locking devices are not acceptable for the remote underwater locations in subsea drilling.

Figure 3:
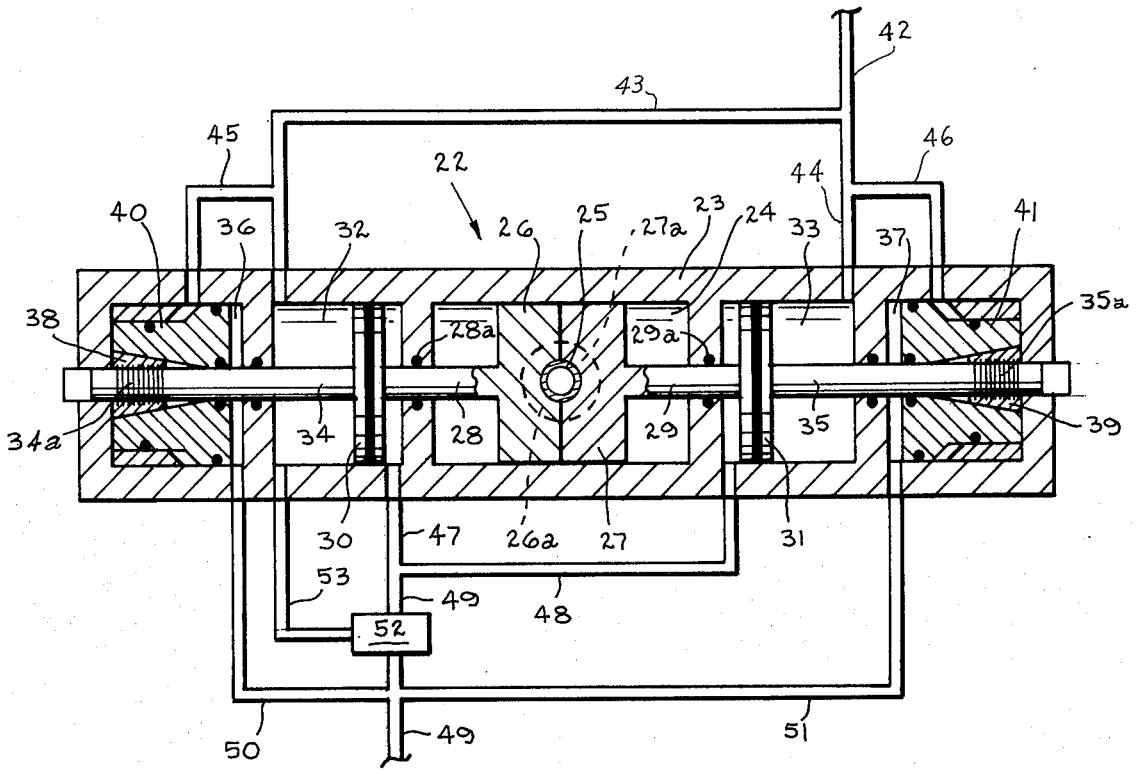
FIG. 3 is a schematic representation of a ram type blowout preventer utilizing locking apparatus according to a preferred embodiment of the invention.

Referring now to FIG. 3, a blowout preventer, generally designated at 22, according to a preferred embodiment of the invention, will be described. The preventer comprises a housing 23 which is provided with a cavity 24 which also forms a part of a passageway therethrough which communicates with the wellhead and casing of the well. A drill string 25 may extend through the passage down into the well hole. Disposed in the housing cavity 24 is a pair of opposing ram members 26 and 27 which are disposed for movement between extended or closed positions (as shown in FIG. 3) and retracted positions. The rams 26 and 27 are provided with suitable seals 26*a* and 27*a* and in the closed position seal off the annular space between the drill string 25 and the passageway through the preventer housing 23.

Each of the rams may be connected by rods 28 and 29 to piston operators 30 and 31 disposed in cylindrical cavities 32 and 33 of the housing 23. Suitable seals 28*a* and 29*a* are provided around the rods 28 and 29. The rods 28 and 29 may extend past pistons 30 and 31 to provide tail rods 34 and 35 which extend into and through other cylindrical cavities 36 and 37. The tail rods 34 and 35 may actually be separate rod members attached to the pistons 30 and 31. It will be noted that the tail rods 34 and 35 are provided with friction engaging surfaces, such as threads 34*a* and 35*a.*

Surrounding the tail rods 34 and 35 within cylinders 36 and 37 are slips 38, 39 and piston assemblies 40 and 41 which in combination with tail rods 34 and 35 make up the locking apparatus of the present invention. The various details of the locking apparatus will be more fully described hereafter.

The outer or outboard ends of operator cylinders 32 and 33 are connected through conduits 42, 43 and 44 to a pressure source (not shown) for closing the blowout preventer rams. The locking apparatus cylinders 36 and 37 are also connected to the same pressure source by conduits 45 and 46. The inner or inboard ends of the operator cylinders 32 and 33 are connected by conduits 47, 48 and 49 to a second pressure source (not shown) for opening the blowout preventer rams. This same pressure source is also connected by conduits 50 and 51 to the locking cylinders 36 and 37. A pilot operated check valve 52, to be described hereafter, may be connected at the junction between conduit 49 and an additional conduit 53 which is also connected to at least one of the operator cylinders 32.

Figure 4:
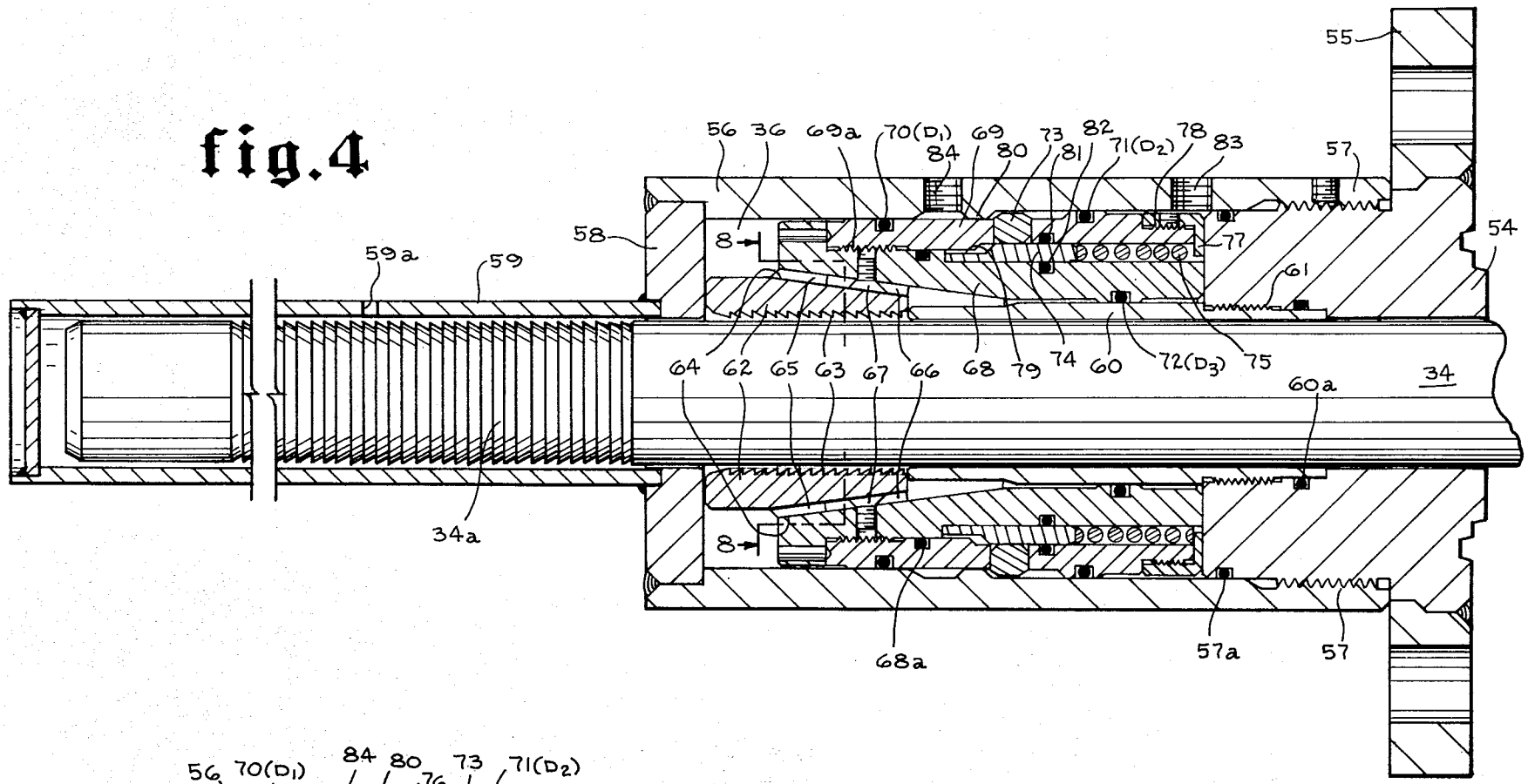
FIG. 4 is a longitudinal cross-sectional view of a portion of the blowout preventer of FIG. 3 showing the locking apparatus in the released or unlocked position.

Referring now to FIG. 4, a more thorough description of the locking apparatus will be given. The locking apparatus may be actually constructed as a separate unit for attachment to the housing of the blowout preventer. As such, it may be provided with a hub 54 and flange 55 for direct attachment to the blowout preventer adjacent one of the operator cylinders (such as 32 shown in FIG. 3). The locking cylinder 36 may be defined by a surrounding tubular housing 56 attached, such as by threads 57, to the hub 54 and closed at the opposite end by annular plate 58. A tubular extension 59 may be attached to plate member 58 in which the outer end of tail rod 34 may be disposed A vent port 59*a* may be provided in tubular extension 59. If used under water, the vent port 59*a* would be connected to a reservoir of oil to prevent entrance of water.

The tail rod 34, as previously explained, is connected to one of the piston members (such as piston 30 in FIG. 3) of the blowout preventer ram operator and reciprocates therewith. Also as previously explained, the tail rod 34 is provided with a friction engaging surface such as threads 34*a.*

Figure 8:
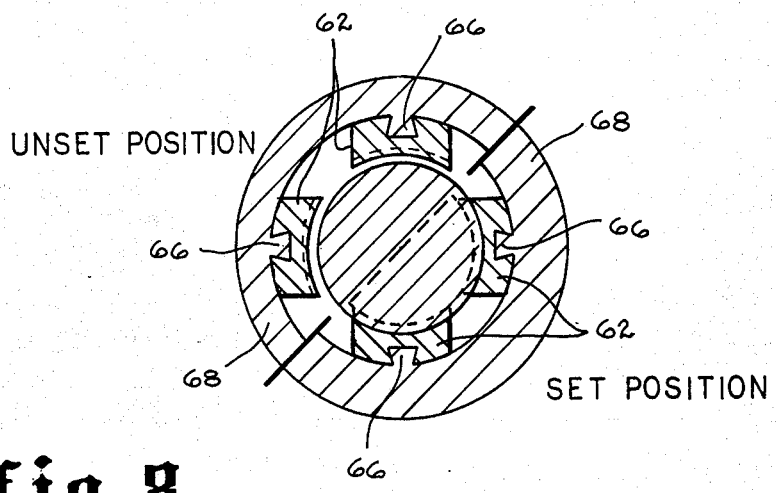
FIG. 8, taken along lines 8—8 of FIGS. 4 and 6, is a transverse cross section illustrating details of the slips and wedge surfaces of a locking apparatus of the present invention.
Figure 6:
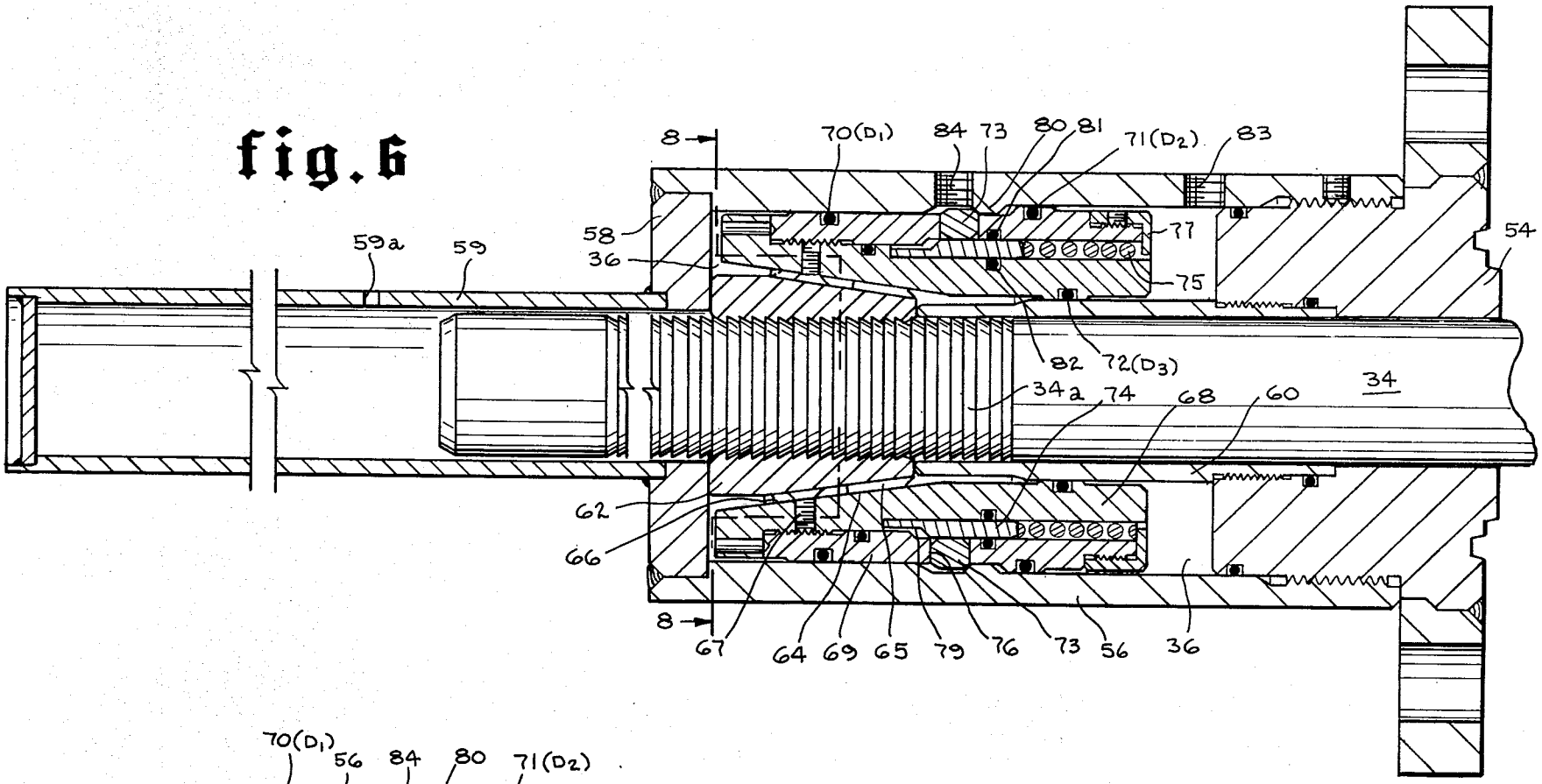
FIG. 6 is a longitudinal cross section view of the locking apparatus of FIG. 4, showing the apparatus in its locked position.

Surrounding the rod 34 within the cylinder 36 is a tubular guide 60, which may be threadedly attached at 61 to hub 54. Disposed between the outer end of tubular guide 60 and annular plate 58 is a plurality of slip members 62. The inner faces of these slip members 62 are provided with friction engaging surfaces such as teeth 63. The outer faces or backs 64 of the slips 62 are tapered, converging toward the axis of tail rod 34 in a direction toward the hub 54. The back of the slips are also provided with a dovetail slot 65 (see also FIG. 8) for engagement with a dovetail key 66 attached by screw 67 to a wedge member 68, to be more fully described hereafter. The slips 62 are mounted for radial movement between retracted positions, as shown in FIG. 4, and inwardly contracted positions as shown in FIG. 6. The wedge member 68 makes up a part of what may be referred to as a piston assembly surrounding tail rod 34 and mounted for reciprocation between a first terminal position, as shown in FIG. 4, and a second terminal position, as shown in FIG. 6. In addition to the tapered wedge member 68, the piston assembly may comprise a surrounding latch sleeve 69 which may be threadedly attached at 69*a* to the wedge member 68. The outside diameter (D1) at seal 70 of the latch sleeve 69 is slightly less than the outside diameter (D2) at seal 71. Seals 70 and 71 provide sliding sealing engagement of the piston assembly with the inner walls of cylinder 36. Another sliding seal 72 (diameter D3) provides sliding sealing engagement of the piston with the tubular guide 60. Other seals 57*a*, 60*a*, 68*a* etc. are provided where needed.

Figure 5:
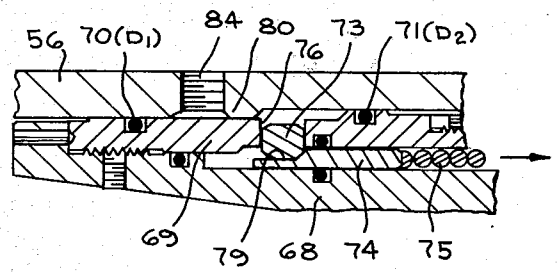
FIG. 5 is a sectional detail of the locking apparatus of FIG. 4, showing release of its retainer so as to allow movement of the locking apparatus to the locked position.

The piston assembly also includes a retainer mechanism for latching the piston assembly in either of its terminal positions. The retainer mechanism comprises latches 73, retainer sleeve 74 and biasing spring 75. The radial latches 73 are disposed within radial windows 76 cut in latch sleeve 69. The retainer sleeve 74 is mounted for limited axial movement within the annular space provided between latch sleeve 69 and wedge member 68. The biasing spring 75 urges the retainer sleeve to the left, as seen in FIG. 4, so that it lies behind latches 73 preventing their retraction within the windows 76. A retainer cap 77 may be threadedly attached at 78 to latch leeve 69. The external diameter of retainer sleeve 74 is reduced at 79 so that if the biasing spring 75 is compressed sufficiently for the reduced diameter portion 79 to lie behind latches 73, they may be retracted within the window 76, as shown in FIG. 5. In the non-retracted position of FIG. 4, engagement of latches 73 with the annular shoulder 80 would prevent movement of the piston assembly, retaining it in the first or unloaded terminal position shown in FIG. 4. It will be noted that annular seals 81 and 82 are provided between the retainer sleeve 74 and latch sleeve 69 and wedge member 68, respectively.

Pressure ports 83 and 84 are provided in the walls of the cylindrical housing 56. Port 84 may be connected (such as by conduits 45, 43 and 42 in FIG. 3) with the pressure source which is used to close the blowout preventer rams. Port 83 may be connected (such as by conduit 50 in FIG. 3) with the pressure source for opening the blowout preventer rams. It will be noted that the annular area bounded by diameters $D_2$ and $D_3$ of the piston assembly is subjected to the pressure applied through port 83 whereas the substantially smaller annular area bounded by the diameters $D_1$ and $D_2$ is subjected to pressure supplied through port 84.

STATEMENT OF OPERATION

Referring now to FIGS. 3–8, operation of the locking apparatus of the present invention will be described. Assuming that the blowout preventer is in the nonsealing or open position, its locking apparatus will be substantially as shown in FIG. 4. Also note the position of tail rod 34. To close the rams of the blowout preventer a relatively high pressure, e.g. 1500 psi, is applied to the piston and cylinder operator assembly of the blowout preventers through conduits 42, 43 and 44 (see FIG. 3). This will cause the rams to move to the closed position, as illustrated in FIG. 3, and with the tail rod reciprocated to its second terminal position, as shown in FIG. 6. Since port 84 is also connected to the closing pressure source this pressure (1500 psi) is applied to the differential area between diameter $D_1$ and diameter $D_2$ and is also applied to the outward or left end (as seen in FIG. 5) of retainer sleeve 74 (differential area between seals 81 and 82). Since the locking piston assembly is resting against hub member 54 already, this pressure has no effect on moving the locking piston assembly from its first terminal position as shown in FIG. 4. However, the high pressure applied to the end of retainer sleeve 74 compresses biasing spring 75 and allows the retainer sleeve 74 to shift to the position shown in FIG. 5. Since the smaller diameter 79 of the retainer sleeves 74 now lies behind radial latches 73, they will be allowed to be retracted within latch window 76.

Figure 7:
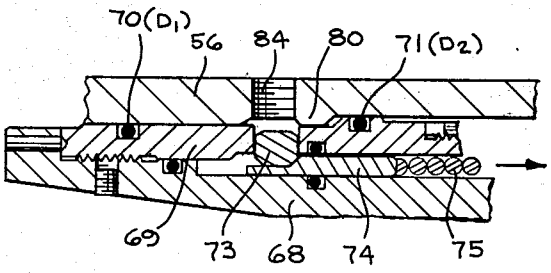
FIG. 7 is a detail sectional view of the retaining device, shown in position for releasing the locking apparatus for return to the unload position.

If it is merely desired to close the blowout preventers without locking the rams in place, nothing further will be done to activate the locking apparatus. However, if it is desired to lock the blowout preventers in the closed or sealed position, a relatively low pressure, e.g. a 150 psi, may now be applied through port 83. Since the differential area between diameters D2 and D3 is substantially greater than the differential areas between diameters D1 and D2, a force results which tends to move the entire locking piston assembly toward the second terminal position shown in FIG. 6. Since the retainer sleeve 74 is in the position shown in FIG. 5, the assembly is permitted to move past shoulder 80 to the position shown in FIG. 6, except that the latches 73 and retainer sleeve 74 will be as shown in FIG. 7. During this movement toward the second terminal position, the wedge member 68 and wedge key 66 forces the slip members 62 radially inwardly to the contracted position of FIG. 6 so that the slip teeth 63 engage the teeth or threads of tail rod 34.

To positively lock the tail rod 34 and consequently the rams of the blowout preventer in the closed position, it will be necessary to maintain the slips 62 in the contracted position. Thus, the locking apparatus piston assembly must be latched or locked in the second terminal position of FIG. 6. This is accomplished by then reducing pressure from the ram closing pressure source so that the pressure applied to port 84 is gradually reduced. As the pressure is reduced, the biasing spring 75 forces the retainer 74 to return to the position shown in FIG. 6 so that its larger diameter portion lies behind the latches 73 locking them in a radially extended position so that their engagement with shoulder 80 will prevent return of the locking apparatus piston assembly. The relative low pressure (150 psi) may also now be reduced to zero leaving only mechanical locking. The locking apparatus is now positively actuated and the rams are positively locked in their closed position.

It should be noted at this point that if it is desired to prevent the relatively low pressure, e.g. 150 psi, which is necessary to activate the locking apparatus, from being applied to the opening side of the ram operator pistons, a pilot operated check valve, such as 52 in FIG. 3 may be provided. Such a valve would be kept closed by the closing pressure admitted through conduit 53, via 42, 43 and 44, and would not admit the 150 psi opening pressure to the conduits 47 and 48 until the higher closing pressure (1500 psi) was removed from operator cylinder 32. However, as soon as the closing pressure was removed from cylinder 32, the valve 52 would open. Such pilot operated check valves are well known in the art and need not be described any further.

Once the blowout preventer is locked in the closed position, it can be checked by merely applying opening pressure to the opening side of pistons 30 and 31. If the rams do not open, the lock is positively assured.

To open the rams and release them from the locked or closed position, in which the locking apparatus is as shown in FIG. 6, closing pressure may gradually be applied to the operating cylinders 32 and 33 to conduits 42, 43 and 44. This places the closing load on the pistons 30 and 31 and slightly unloads the slips 32. With closing pressure maintained on the ram operator pistons, closing pressure is also regulated into the locking apparatus through port 84, first forcing the retainer sleeve 74 to the position shown in FIG. 7. This allows retraction of latches 73 and as pressure is increased in port 84, acting on the differential area between diameters $D_1$ and $D_2$, the locking piston assembly is returned toward the first terminal or unlocked position of FIG. 4, except that the latches 73 and retainer sleeve 74 are in the position of FIG. 5. As the locking piston assembly moves from the second terminal or locked position back to the first terminal or unlocked position, the dovetail key 66 sliding within the dovetail slot 65 of slip 62 causes the slips to be retracted, disengaging the threads of tail rod 34.

When the locking piston assembly has returned to its first terminal position, ram closing pressure is relieved, allowing the latch retainer 74 to return to the initial position shown in FIG. 4, forcing latches 73 to their extended positions and locking the locking piston assembly in its deactivated or unlocked position. At this point opening pressure may be applied to the operating cylinders 32 and 33 through conduits 47, 48 and 49 causing the ram to return to their open position. The rams can now be opened or closed without activating the locking mechanism.

CONCLUSION

As can be seen from the foregoing description, the locking apparatus of the present invention is a highly reliable and efficient one. It offers more advantages than any of the locking apparatus of the prior art without the disadvantages inherent in those designs. It is easy to operate and results in an improved method of operating a blowout preventer.

Although only one preferred embodiment of the invention has been described herein, many others will be apparent to those skilled in the art. For example, the locking apparatus of the present invention could be used with flow control devices other than blowout preventers. In fact the locking apparatus of the present invention could be used in many ways and the scope of the invention is intended to be limited only by the claims which follow.

I claim:

1. Locking apparatus in combination with a ram type blowout preventer having a housing with a passageway through which a tubular member may pass; ram means movable between a non-sealing position in said housing, in which said passageway is open, and a sealing position in which said passageway is sealingly closed; and operator means for moving said ram means between said non-sealing and sealing positions; said locking apparatus comprising:

a. rod means connected to said operator means reciprocable between first and second terminal positions in response to movement of said ram means between said non-sealing and sealing positions, respectively; and b. locking means comprising slip means non-longitudinally and radially movable from a retracted position, not engaging said rod means, to a contracted position engaging said rod means, when in said second terminal position to lock said ram means in said sealing position, said locking means comprising wedge means engaging said slip means and movable from a first position, holding said slip means in said retracted position, to a second position holding said slip means in said contracted position.

2. Locking apparatus as set forth in claim 1 in which said locking means comprises mutually engageable cooperating teeth on said slip means and said rod means to positively lock said ram means in said sealing position.

3. Locking apparatus as set forth in claim 2 in which said wedge means comprises a piston assembly mounted in a cylinder movable in response to pressure applied to said cylinder to effect said longitudinal movement of said wedge means.

4. Locking apparatus as set forth in claim 1 in which said wedge means is carried on a piston assembly surrounding said rod means and disposed within a cylinder for reciprocal movement between first and second terminal positions, in which said wedge means is in its first and second positions, respectively.

5. Locking apparatus in combination with a flow control device having a body with a flow passage therethrough, hydraulic cylinder means in which is disposed piston means for movement between first and second terminal positions and closure means connected to said piston means and movable in response thereto from an open position in which said flow passage is open to a closed position in which flow passage is closed thereby, said locking apparatus comprising:

a. rod means axially aligned and movable with said piston means between first and second terminal positions;

b. wedge means carried by said body and surrounding said rod means for longitudinal movement relative thereto; and c. slip means engaging said wedge means and radially movable, in response to said longitudinal movement of said wedge means, between a position not engaging said rod means and a position engaging said rod means to lock said closure means in said closed position;

d. said wedge means comprising a piston assembly mounted in a cylinder movable in response to pressure applied to said cylinder to effect said longitudinal movement of said wedge means and latch means for selectively preventing said longitudinal movement of said piston assembly.

6. Locking apparatus as set forth in claim 5 in which said latch means comprises a plurality of radial latches held in extended positions by a retainer sleeve, said retainer sleeve being movable in response to a predetermined pressure applied through first port means in said cylinder to release said latches for movement toward retracted positions.

7. Locking apparatus as set forth in claim 6 in which said piston assembly is movable, when said latches are retracted, in response to a predetermined pressure applied through second port means in said cylinder, to a position in which said slip means is engaging said rod means.

8. Locking apparatus as set forth in claim 7 in which said predetermined pressure applied through said second port means is substantially less than the predetermined pressure applied through said first port means.

9. Locking apparatus as set forth in claim 5 in which said piston assembly comprises a first relatively small pressure area subjected to pressure applied through one end of said cylinder and a second relatively larger pressure area subjected to pressure applied through the opposite end of said cylinder so that a pressure in said opposite end of said cylinder which is substantially less than the pressure in said one end of said cylinder will effect said longitudinal movement of said wedge means to said position in which said rod means is engaged by said slip means.

10. Locking apparatus as set forth in claim 9 in which said latch means prevents movement of said wedge means to said engaging position, said latch means being releasable to permit said movement of said wedge means to said engaging position, said latch means being then operable to prevent return of said wedge means to said nonengaging position.

11. In combination with a ram type blowout preventer having a housing with a passageway through which a tubular member may pass, ram means movable between a non-sealing position in said housing, in which said passageway is open, and a sealing position in which said passageway is sealingly closed; and operator means for moving said ram means between said non-sealing and sealing positions; locking apparatus comprising:

a. rod means connected to said operator means and reciprocable between first and second terminal positions in response to movement of said ram means between said non-sealing and sealing positions, respectively;

b. slip means radially movable from a retracted position, not engaging said rod means, to a contracted position engaging said rod means, when said rod means is in said second terminal position, to lock said ram means in said sealing position;

c. wedge means engaging said slip means and movable from a first position, holding said slip means in said retracting position, to a second position holding said slip means in said contracted position, said wedge means being carried on a piston assembly surrounding said rod means and disposed within a cylinder for reciprocal movement between first and second terminal positions, in which said wedge means is in its first and second positions, respectively, said piston assembly comprising latch means engageable with stop means in said cylinder to lock said piston assembly in either of its said terminal positions, said latch means being releasable to permit movement of said piston assembly between said terminal positions.

12. Locking apparatus as set forth in claim 11 in which said piston assembly comprises retainer means engaging said latch means to hold said latch means in engagement with said stop means, said retainer means being movable in response to pressure applied to said cylinder through a first port to permit disengagement of said latch means from said stop means.

13. Locking apparatus as set forth in claim 11 in which said piston assembly comprises a first pressure area facing away from said first terminal position and a second pressure area facing away from said second terminal position.

14. Locking apparatus as set forth in claim 13 in which said cylinder is provided with a first port through which pressure may be applied to said first pressure area and a second port through which pressure may be applied to said second pressure area.

15. Locking apparatus as set forth in claim 14, in which said operator means in pressure operated, the source of pressure for moving said ram means to said sealing position also being connected to said first port.

16. Locking apparatus as set forth in claim 15 in which said second port is connected to a source of pressure less than that for moving said ram means to said sealing position, said second pressure area being greater than said first pressure area so that the differential pressure in said first and second ports tends to move said piston assembly toward said second terminal position.

17. A method of operating a ram type blowout preventer having ram means movable between open and closed positions, hydraulic operator means for moving said ram means, and locking means for locking said ram means in said closed position, said method comprising:

a. closing said ram means by applying a first pressure level to said operator means;

b. activating said locking means by simultaneously applying said first pressure level to a portion of said locking means;

c. moving said locking means into engagement with said operator means by applying a second pressure level, substantially less than said first pressure level, to another portion of said locking means; and d. locking said ram means in said closed position by reducing said first pressure level so as to lock said locking means in engagement with said operator means.

18. The method of claim 17 in which said first pressure level is maintained while said second pressure level is applied.

19. The method of claim 17 and the further step of:

e. reducing said second pressure level.

20. The method of claim 19 and the further steps of:

f. reapplying said first pressure level to said operator;

g. slowly reapplying said first pressure level to said a portion of said locking means, while maintaining said first pressure level on said operator means to release said locking means;

h. maintaining said first pressure level on said a portion of said locking means to move said locking means out of engagement with said operator means; and i. reducing said first pressure level to latch said locking means in said nonengaged position.

21. The method of claim 20 and the further step of:

j. opening said ram means by applying pressure to said operator means.

* * * * *